US006966385B2

(12) United States Patent
Hemphill et al.

(10) Patent No.: US 6,966,385 B2
(45) Date of Patent: Nov. 22, 2005

(54) TONG POSITIONING SYSTEM AND METHOD

(75) Inventors: Lance L. Hemphill, Houma, LA (US); Randolph L. Stuart, Odessa, TX (US)

(73) Assignee: Eckel Manufacturing Co., Inc., Odessa, TX (US)

( * ) Notice: Subject to any disclaimer, the term of this patent is extended or adjusted under 35 U.S.C. 154(b) by 55 days.

(21) Appl. No.: 10/428,577

(22) Filed: May 2, 2003

(65) Prior Publication Data

US 2004/0216890 A1 Nov. 4, 2004

Related U.S. Application Data

(60) Provisional application No. 60/444,518, filed on Feb. 3, 2003.

(51) Int. Cl.[7] ..... E21B 19/16
(52) U.S. Cl. ..... 166/380; 166/77.51; 81/57.2

(58) Field of Search ..... 166/377, 378, 166/380, 77.51, 85.1, 85.5; 81/57.15, 57.16, 81/57.2, 57.33, 57.34, 57.35

(56) References Cited

U.S. PATENT DOCUMENTS 4,843,945 A * 7/1989 Dinsdale ..... 81/57.34
6,591,471 B1 * 7/2003 Hollingsworth et al. . 29/407.09

* cited by examiner

*Primary Examiner*—Zakiya Walker
(74) *Attorney, Agent, or Firm*—Browning Bushman

(57) ABSTRACT

A tong positioning system positions a power tong about an oilfield tubular connection to make up or break out a threaded connection. An extendable arm and a retainer device on the extendable arm. In a preferred embodiment, the retainer device comprises opposing laterally-movable retainer arms defining an adjustable opening for at least partially enclosing one of the upper tubular and the lower tubular. The extendable arm is retractable for thereafter moving the power tong laterally toward the tubular connection.

39 Claims, 14 Drawing Sheets

TONG POSITIONING SYSTEM AND METHOD

RELATED CASE

The present application claims priority from U.S. Ser. No. 60/444,518 filed Feb. 3, 2003, hereby incorporated by reference.

FIELD OF THE INVENTION

This invention relates to a tong positioning system for positioning a power tong about an oilfield tubular connection. More particularly, the powered tong positioning system safely and reliably moves the power tong on and off the tubular connection.

BACKGROUND OF THE INVENTION

In conventional tubular string run-in and recovery operations, it is necessary to "make-up" or "break-out" the threaded connections between tubing, casing, or pipe joints near the rig floor. Generally, a first joint is positioned within the wellbore and a second joint is positioned above the first. A power operated tong is brought to the connection area of the two joints and rotated to either tighten or loosen the connection. A back-up tong may also be used to prevent rotation of the lower joint when the tong is making up or breaking out the upper joint.

Bringing the tong to the threaded connection may be a long, laborious, and even dangerous operation. The tong must first be brought to tubing, casing, or pipe string, which may require a considerable amount of calculation and effort. Often, one or more human operators must "man-handle" or manipulate the tong manually over the wellbore or other tubular location in order to properly position the tong on the tubular string. Due to the size and weight of tongs and the complexities of the make-up and break-out operations, this is not easily or quickly accomplished.

Systems have been designed to facilitate manipulation of the tong with respect to the rig floor and thus the tubular string. Some systems guide the tong on a track or rail mounted to the rig floor. This is not ideal, as the system occupies valuable rig-floor space and generally requires a permanent installation. Other systems use magnets to temporarily fix a tong support frame to the rig floor. For a variety of reasons, the prior art has shortcomings and a large amount of time and cost is used to move the tong to or from the tubing, casing or pipe connection before and after each make-up or break-out operation. A better tong positioning system is therefore required that is more safe, reliable, and efficient to operate.

This disadvantages of the prior art are overcome by the present invention, and an improved tong positioning system is hereinafter disclosed for reliability and safely moving a power tong with respect to a drilling rig between an active position wherein the powered tong is positioned for making up or breaking out a connection, and an inactive position wherein the power tong is spaced laterally from the connection.

SUMMARY OF THE INVENTION

An automated tong positioning system is provided for positioning a power tong about an oilfield tubular connection, wherein the power tong rotatably makes up and breaks out the connection on a rig of a well. A frame is moveable relative to an upper tubular and a lower tubular. A telescoping retainer assembly includes an extendable arm and a retainer device. The laterally extendable arm is secured to the frame, and has a cantilevered end extendable toward the tubular connection. The retainer device on the cantilevered end is positioned in a substantially predetermined position relative to the tubular connection. The cantilevered end of the extendable arm is retractable for thereafter moving the power tong laterally toward the tubular connection.

A powered drive is preferably included for extending and retracting the extendable arm. The powered drive may comprise one or more hydraulically powered cylinders, and/or a rack and pinion mechanism. A preferred embodiment of the powered drive for many applications may include an electrically powered servo motor driving a screw mechanism to laterally move the retainer device forward and away from the connection.

The retainer device may engage either the lower tubular or the upper tubular. The retainer device may define an adjustable opening for selectively widening or narrowing the adjustable opening, such that the adjustable opening may be widened to pass one of the upper and lower tubular substantially through the adjustable opening, and thereafter narrowed for at least partially enclosing the one of the upper and lower tubular, to removably secure the retainer device to the one of the upper and lower tubular.

The retainer device may have opposing retainer arms laterally movable toward and away from one another. The retainer arms define the adjustable opening between the retainer arms, such that moving the retainer arms toward one another narrows the adjustable opening, and moving the retainer arms away from one another widens the adjustable opening. At least one hydraulic or pneumatic cylinder may be included for moving at least one of the retainer arms, to selectively narrow or widen the adjustable opening.

The retainer device alternatively may comprise a magnetic member for magnetically positioning and securing the cantilevered end with respect to a magnetic post structurally separate from the tong positioning system. The magnetic post may be substantially fixed relative to the tubular connection, and the magnetic member may include an electromagnetic portion.

A low friction member may be positioned substantially between the retainer device and the one of the upper tubular and the lower tubular. The retainer device may further comprise an arcuate seating surface for seating with one of the upper tubular and the lower tubular.

A lifting member may be included that is removably securable to the frame for at least partially unweighting the frame prior to moving the frame toward the tubular connection. The lifting member may comprise a cable supported on a lifting device structurally separate from the frame. The cable may be movable substantially upward and downward, for selectively unweighting the frame.

A spacer box may be included, positionable adjacent to the tubular connection, for at least partially supporting the weight of the frame on the spacer box. Adjustable legs may also be included that are movable up and down for adjusting the height of the ATPS.

A counterbalance member may be provided for counterbalancing the extendable arm. The counterbalance member may include a weight supported from and movable relative to the frame.

At least one flexible member may be secured to the frame for rotationally aligning the frame and the tong supported thereon with respect to the tubular connection.

A backup tong may be supported on the frame for holding one of the upper and lower tubular stationary while the power tong rotates the other of the upper and lower tubular.

These and further features and advantages of the present invention will become apparent from the following detailed description, wherein reference is made to the figures in the accompanying drawing.

BRIEF DESCRIPTION OF THE DRAWINGS

FIG. 1 shows a side view of the ATPS with the telescoping retainer assembly in the fully retracted position.

FIG. 2 shows a top view of the ATPS with the telescoping retainer assembly in the fully retracted position of FIG. 1.

FIG. 3 shows a side view of the ATPS with the telescoping retainer assembly in the partially extended position FIG. 4 shows a top view of the ATPS with the telescoping retainer assembly in the partially extended position of FIG. 3.

FIG. 5 shows a side view of the ATPS with the telescoping retainer assembly in the fully extended position.

FIG. 6 shows a top view of the ATPS with the telescoping retainer assembly in the fully extended position of FIG. 5.

FIG. 7 shows a side view of the ATPS with the telescoping retainer assembly in the fully extended position, secured to the upper tubular segment.

FIG. 8 shows a top view of the ATPS with the telescoping retainer assembly in the fully extended and secured position of FIG. 7.

FIG. 9 shows a top view of the ATPS with the telescoping retainer assembly secured to the upper tubular segment after the telescoping retainer assembly has moved back to the fully retracted position.

FIG. 10 shows a side view of the ATPS with the telescoping retainer assembly in the secured and again retracted position of FIG. 9.

FIG. 11 shows a side view of the ATPS with the telescoping retainer assembly in the fully retracted position.

FIG. 12 shows a top view of the ATPS with the telescoping retainer assembly in the fully retracted position of FIG. 11.

FIG. 13 shows a side view of the ATPS with the telescoping retainer assembly in the partially extended position.

FIG. 14 shows a top view of the ATPS with the telescoping retainer assembly in the partially extended position of FIG. 13.

FIG. 15 shows a side view of the ATPS with the telescoping retainer assembly in the fully extended position.

FIG. 16 shows a top view of the ATPS with the telescoping retainer assembly in the fully extended position of FIG. 15.

FIG. 17 shows a side view of the ATPS with the telescoping retainer assembly in the fully extended position, secured to the lower tubular segment.

FIG. 18 shows a top view of the ATPS with the telescoping retainer assembly in the fully extended and secured position of FIG. 17.

FIG. 19 shows a top view of the ATPS with the telescoping retainer assembly secured to the lower tubular segment after the telescoping retainer assembly has moved back to the fully retracted position.

FIG. 20 shows a side view of the ATPS with the telescoping retainer assembly in the secured and again retracted position of FIG. 19.

DETAILED DESCRIPTION OF PREFERRED EMBODIMENTS

Figure 2:
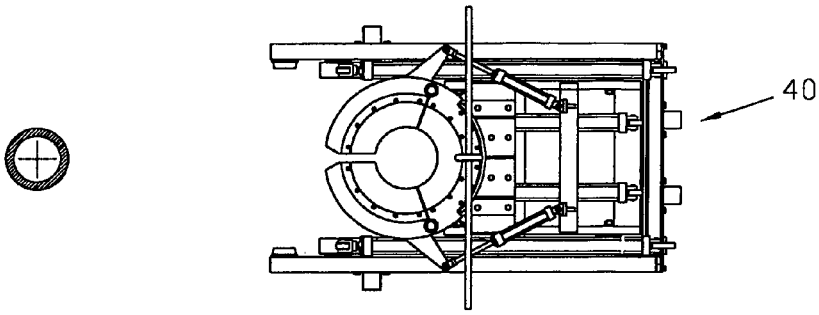
FIGS. 1–10 illustrate one embodiment of an automated tong positioning system (ATPS) in various positions of operation.

FIGS. 1–10 show a preferred embodiment of an automated tong positioning system (ATPS) 10 positioned above a rig floor 12 adjacent a wellbore 14. A lower tubular segment 18 is positioned substantially within the wellbore 14. An upper tubular segment 16 is positioned above the lower tubular segment 18 for subsequent connection to the lower tubular segment 18 via a threaded connection or joint 24. The upper and lower tubular segments 16, 18 may be tubing, casing, drill pipe or other tubular members used in drilling, recovery, and well servicing operations.

Figure 1:
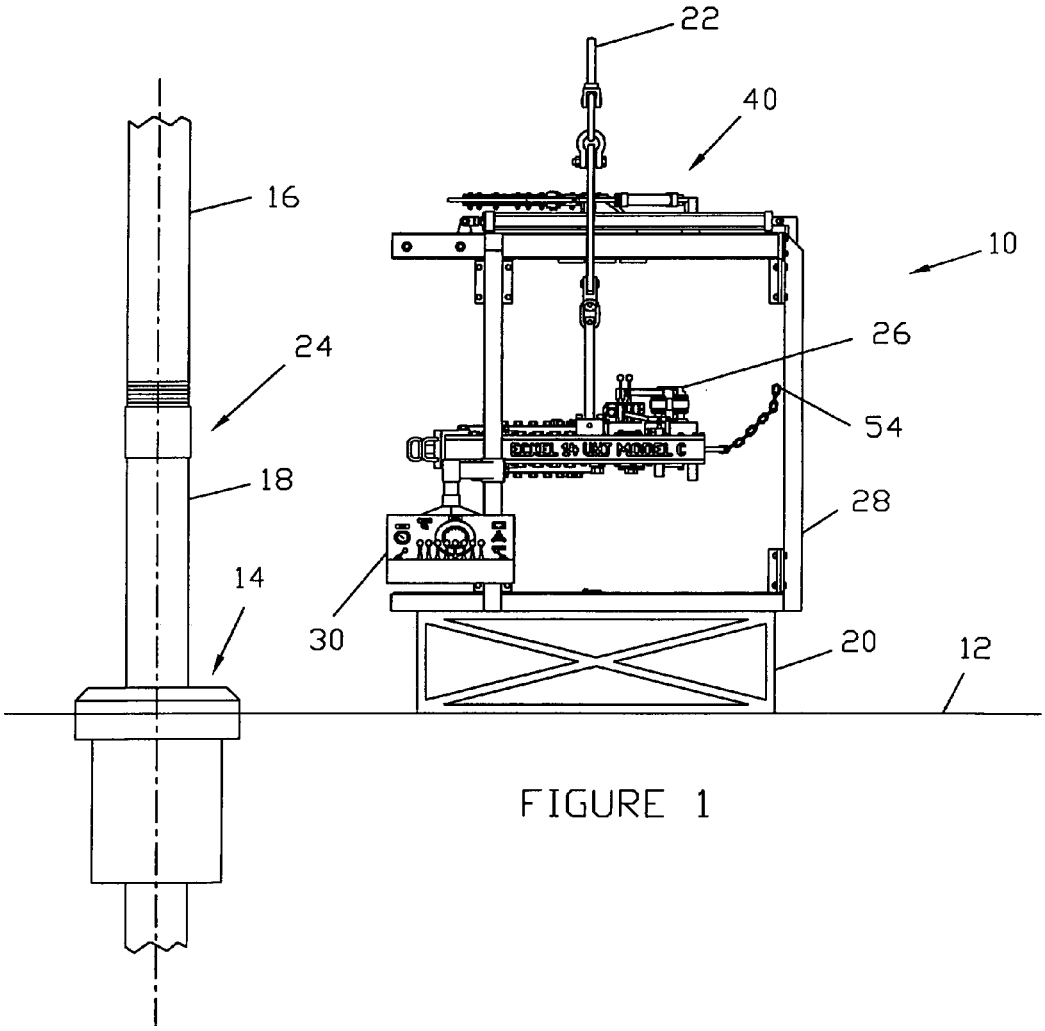
Figure 22:
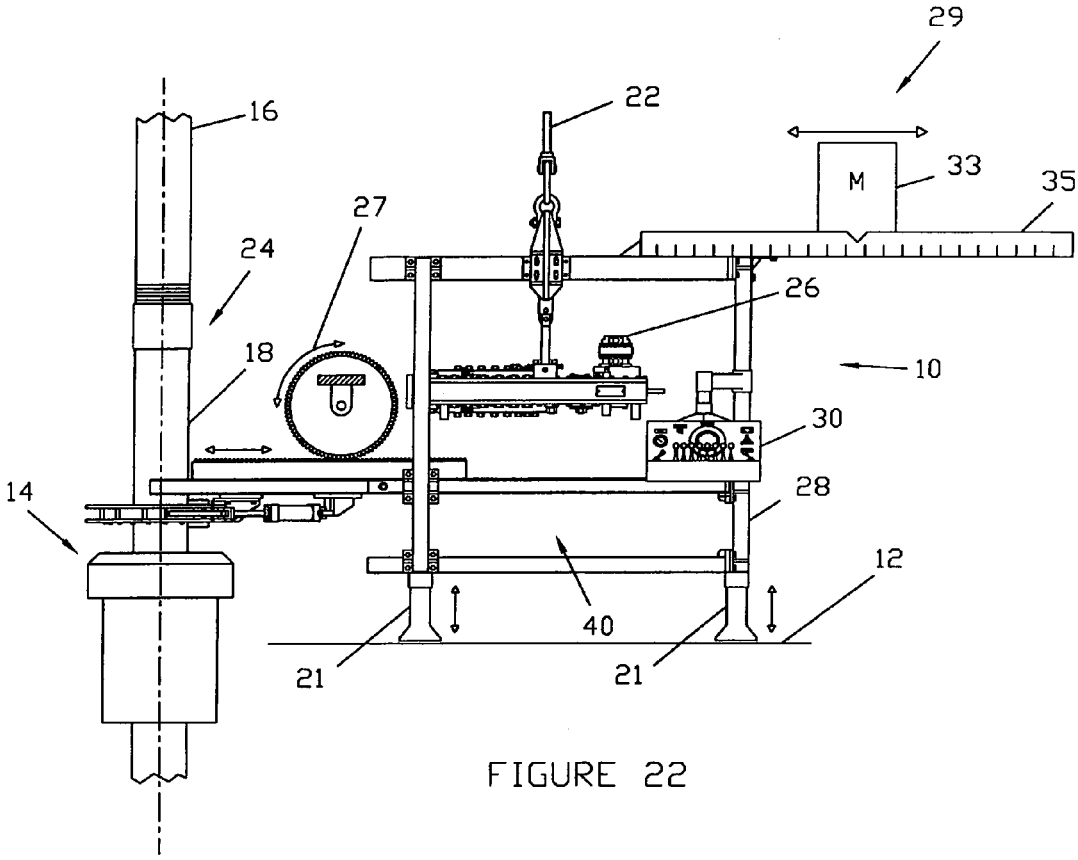
FIG. 22 illustrates an embodiment of the ATPS including a counterbalance member, a rack and pinion system, and adjustable legs.
Figure 23:
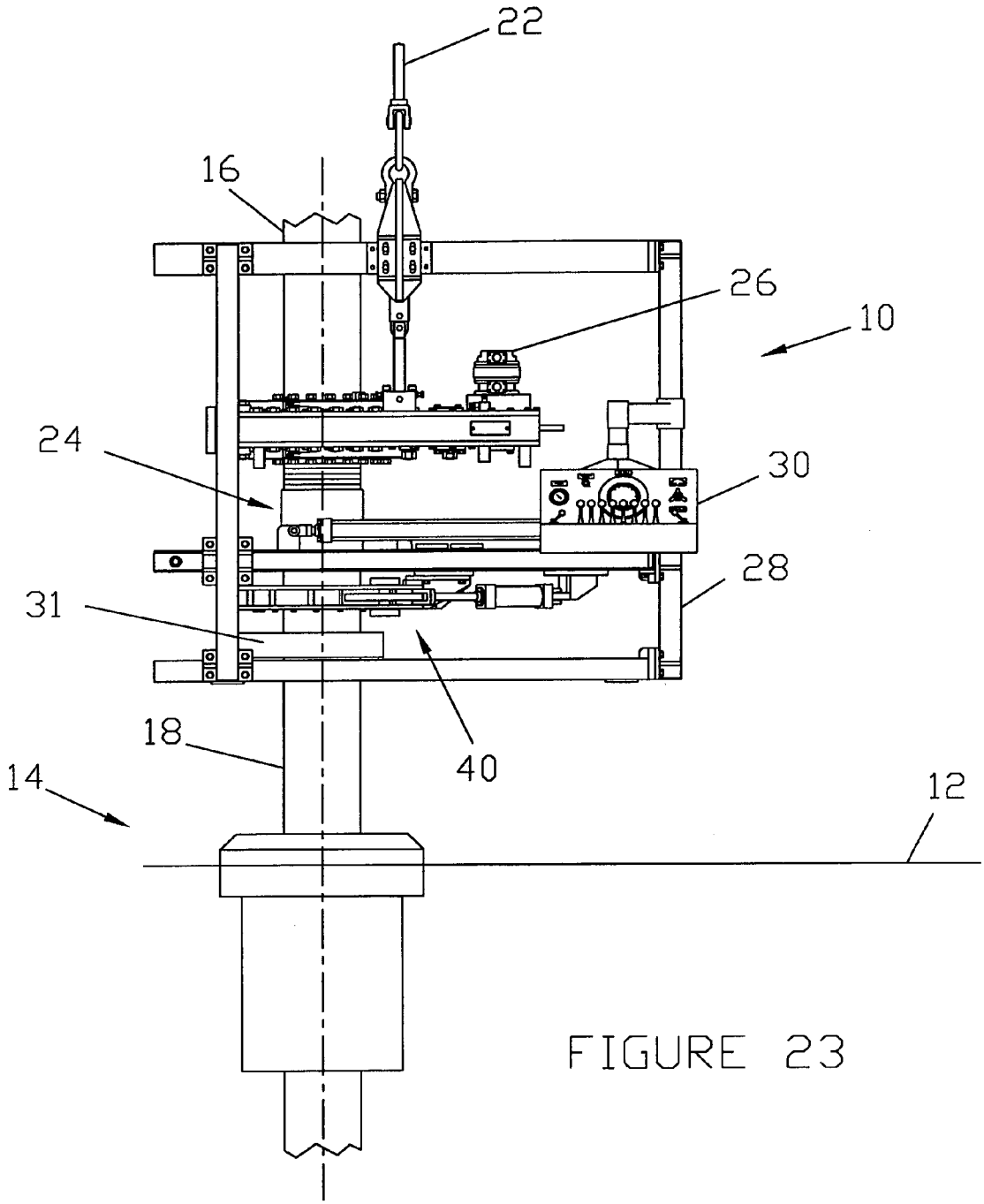
FIG. 23 illustrates an embodiment of the ATPS including a backup tong for engagement with the lower tubular segment.

The ATPS 10 may normally be vertically spaced from the rig floor 12 by spacer box 20, as shown in FIGS. 1–10, or by using adjustable legs 21, as shown in FIG. 22. A lift cable 22 is connected to the ATPS 10 with enough slack in the cable 22 such that some or all of the weight of the ATPS 10 rests on the spacer box 20 and/or rig floor 12. The lift cable 22 is capable of subsequently lifting and supporting the ATPS 10 above the spacer box 20. A power tong 26 is attached to a frame 28, which frame 28 may also support other components of the ATPS 10, including a backup tong 31 (see FIG. 23) for rotatably fixing segment 18 in place. The backup tong 31 may also substantially prevent rotation of the ATPS 10 about the connection 24 during the makeup operation. A telescoping retainer assembly 40 supported on the frame 28 is shown in FIG. 1 in a fully retracted position. The telescoping retainer assembly 40 may be used subsequently to extend toward and enclose the upper tubular segment 16. FIG. 2 shows a top view of the telescoping retainer assembly in the fully retracted position of FIG. 1.

Figure 4:
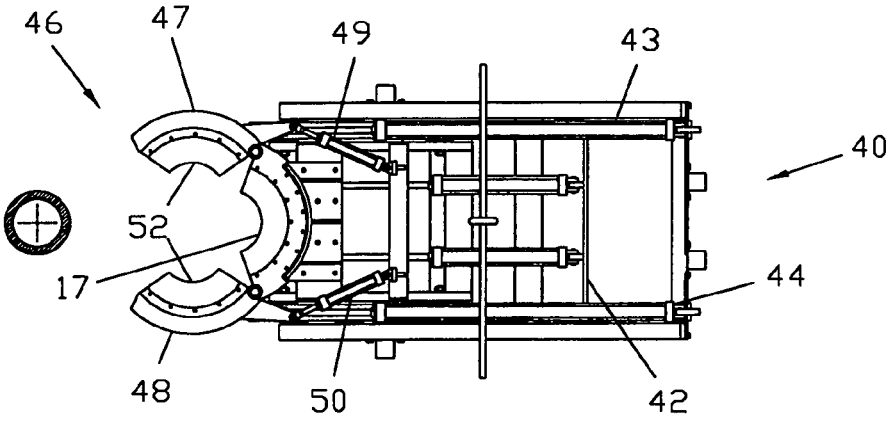
Figure 3:
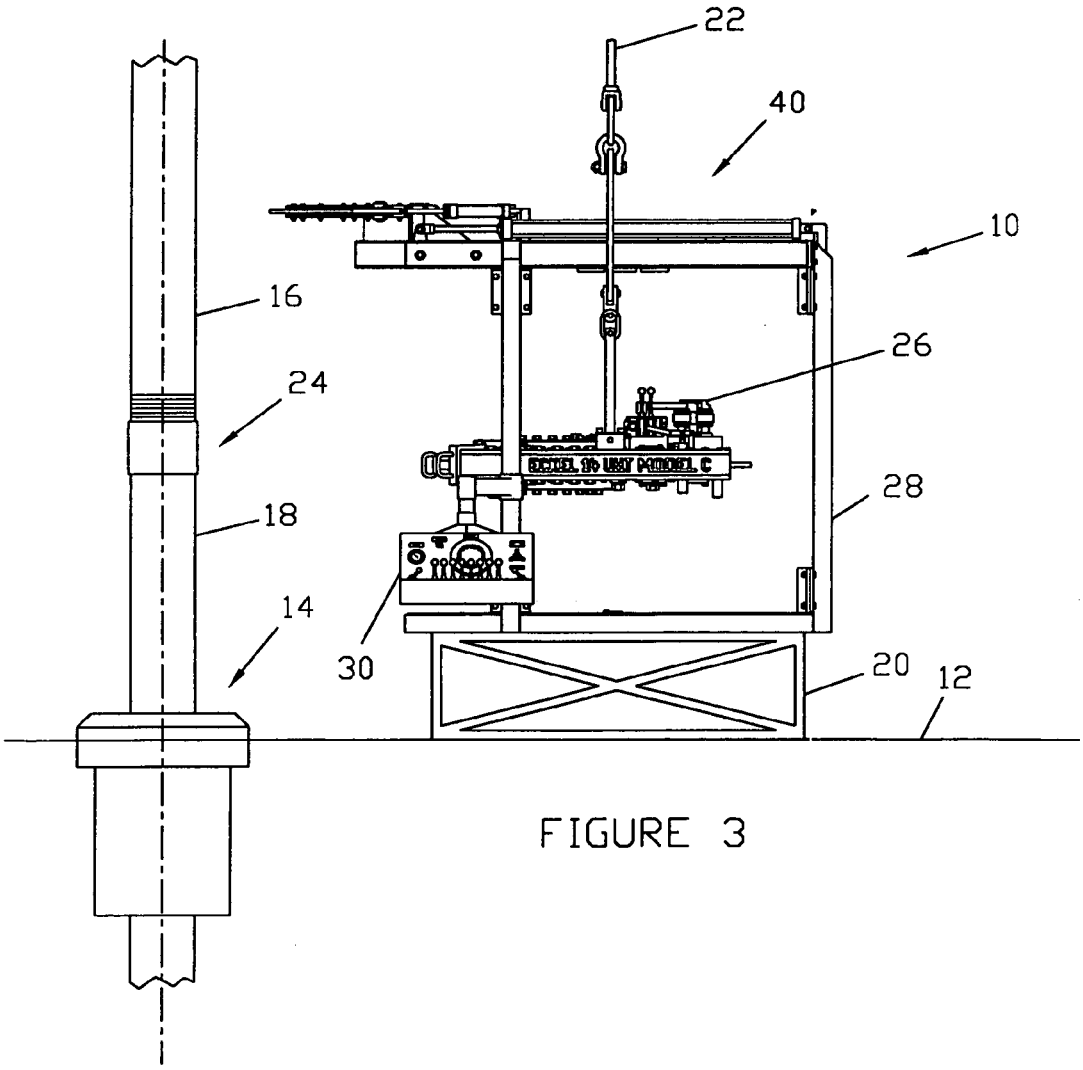

FIG. 3 shows a side view of the ATPS 10 with the telescoping retainer assembly 40 in a partially extended position, extending toward the upper tubular segment 16. The ATPS 10 preferably remains on the spacer box 20 or adjustable legs as the telescoping retainer assembly 40 is extended. FIG. 4 shows a top view of the partially extended telescoping retainer assembly 40 of FIG. 3. The telescoping retainer assembly includes a telescoping arm 42 for extending the telescoping retainer assembly 40 toward the segments 16, 18. The telescoping arm 42 may comprise at least one hydraulic cylinder, and preferably a pair of cylinders 43, 44 positioned on opposing sides of the centerline at the tubular string while extending the telescoping arm 42. A retaining device 46 is supported on the telescoping arm 42, for subsequently enclosing the upper tubular segment 16. The retaining device 46 may include opposing retainer arms 47, 48, which may be laterally movable via cylinders 49, 50.

Figure 6:
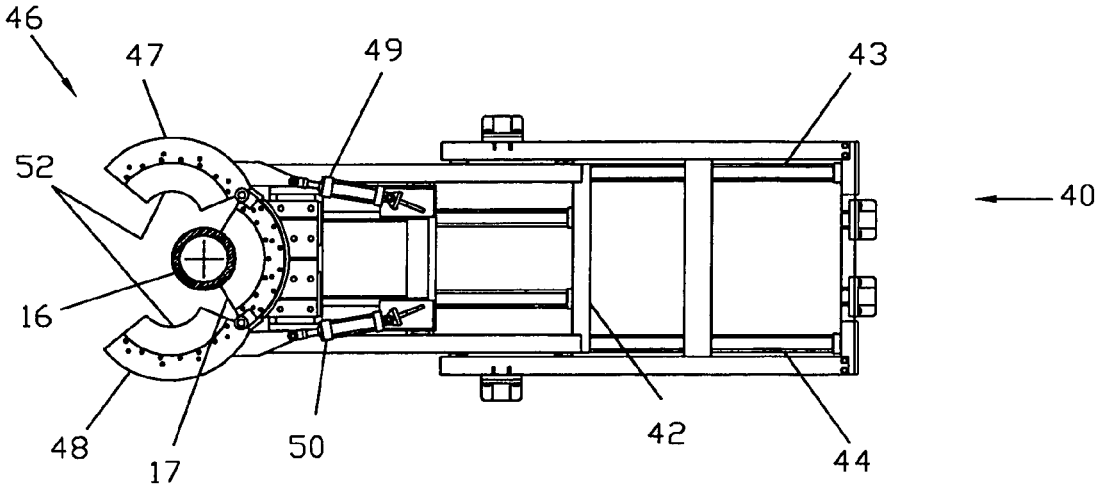
Figure 5:
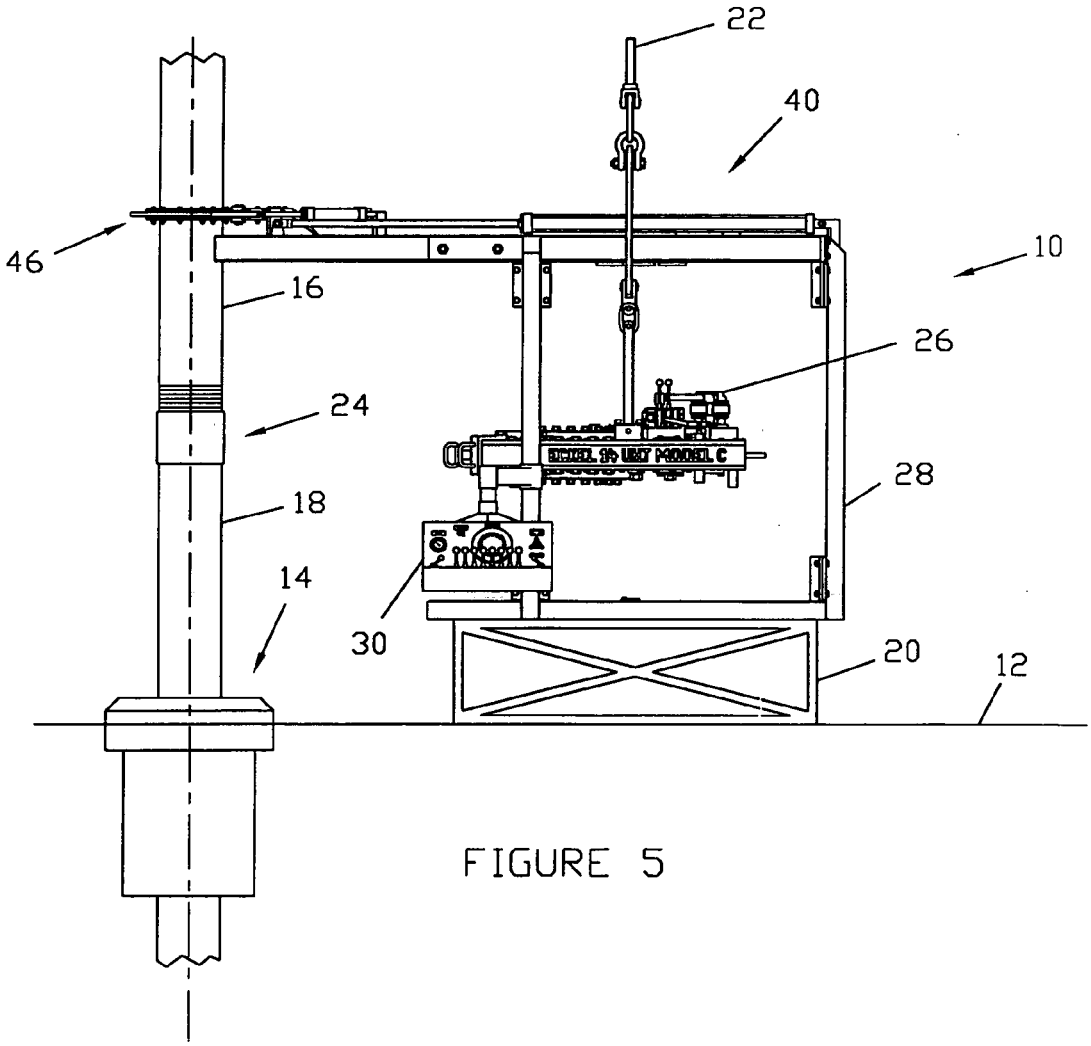

FIG. 5 shows a side-view of the ATPS 10 with the telescoping retainer assembly 40 in a fully extended position, with the retaining device 46 adjacent to and/or substantially contacting the upper tubular segment 16. FIG. 6 shows a top view of the fully extended telescoping retainer assembly 40 of FIG. 5. Once positioned as shown in FIG. 5, the retainer arms 47, 48 may then be closed about the upper tubular segment 16 by activating the cylinders 49, 50 to secure the retainer assembly 40 about the upper tubular segment 16.

FIG. 6 shows a top-view of the fully extended telescoping retainer assembly 40 of FIG. 5. Once positioned as shown in FIG. 5, the retainer arms 47, 48 may then be closed about the upper tubular segment 16 by activating the cylinders 49, 50 to secure the retainer device 46 about the upper tubular segment 16.

Figure 8:
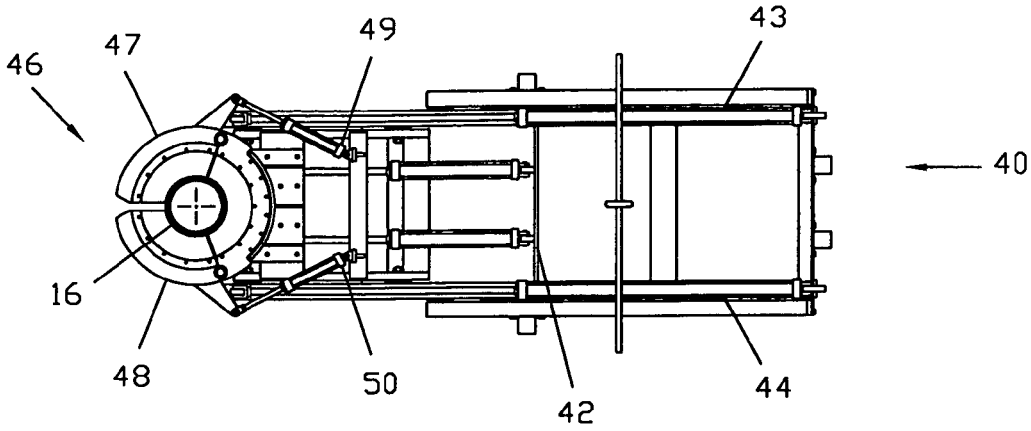
Figure 7:
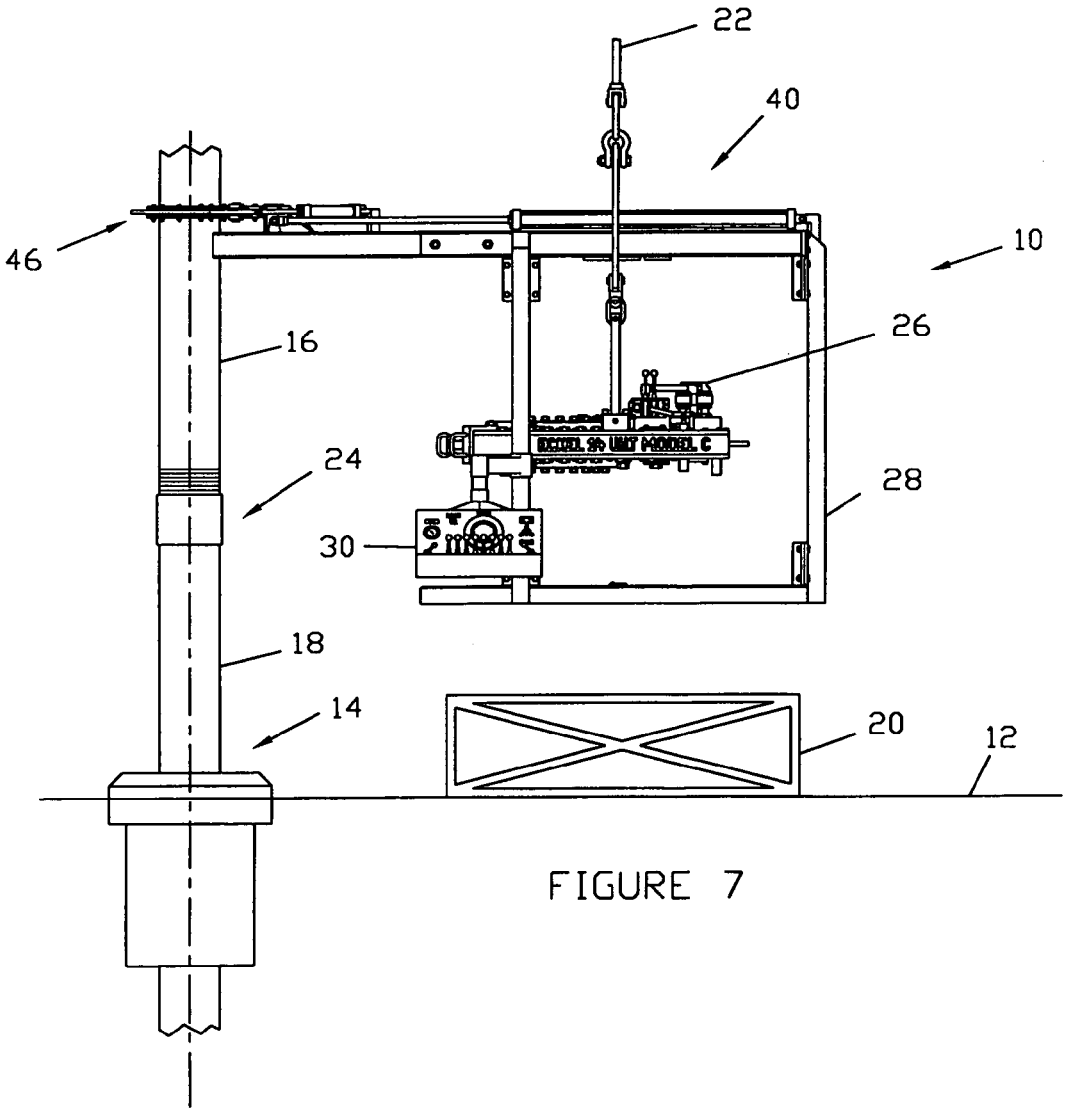

FIG. 7 shows a side view of the ATPS 10, with the telescoping retainer assembly 40 in the fully extended position, and with the retainer arms 47, 48 moved laterally inward to engage the upper tubular segment 16 and secure the retainer device 46 to the upper tubular segment 16. FIG. 8 shows a top-view of the fully extended and secured telescoping retainer assembly 40 of FIG. 7. At this stage, the ATPS 10 may be unweighted and lifted from the spacer box 20 using the lift cable 22. The ATPS 10 is now aligned with the upper tubular segment 16, ready to be moved towards the connection 24.

Figure 10:
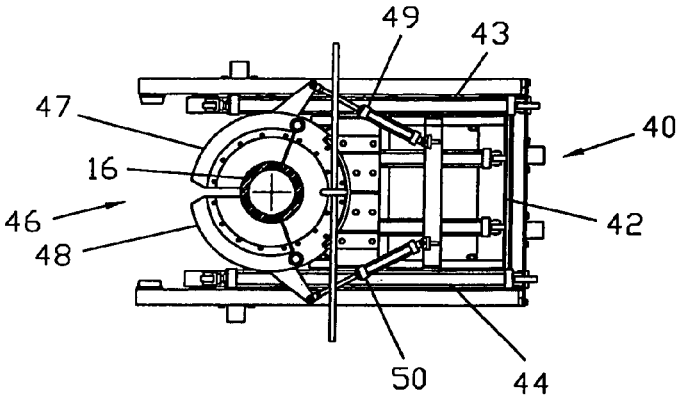
Figure 9:
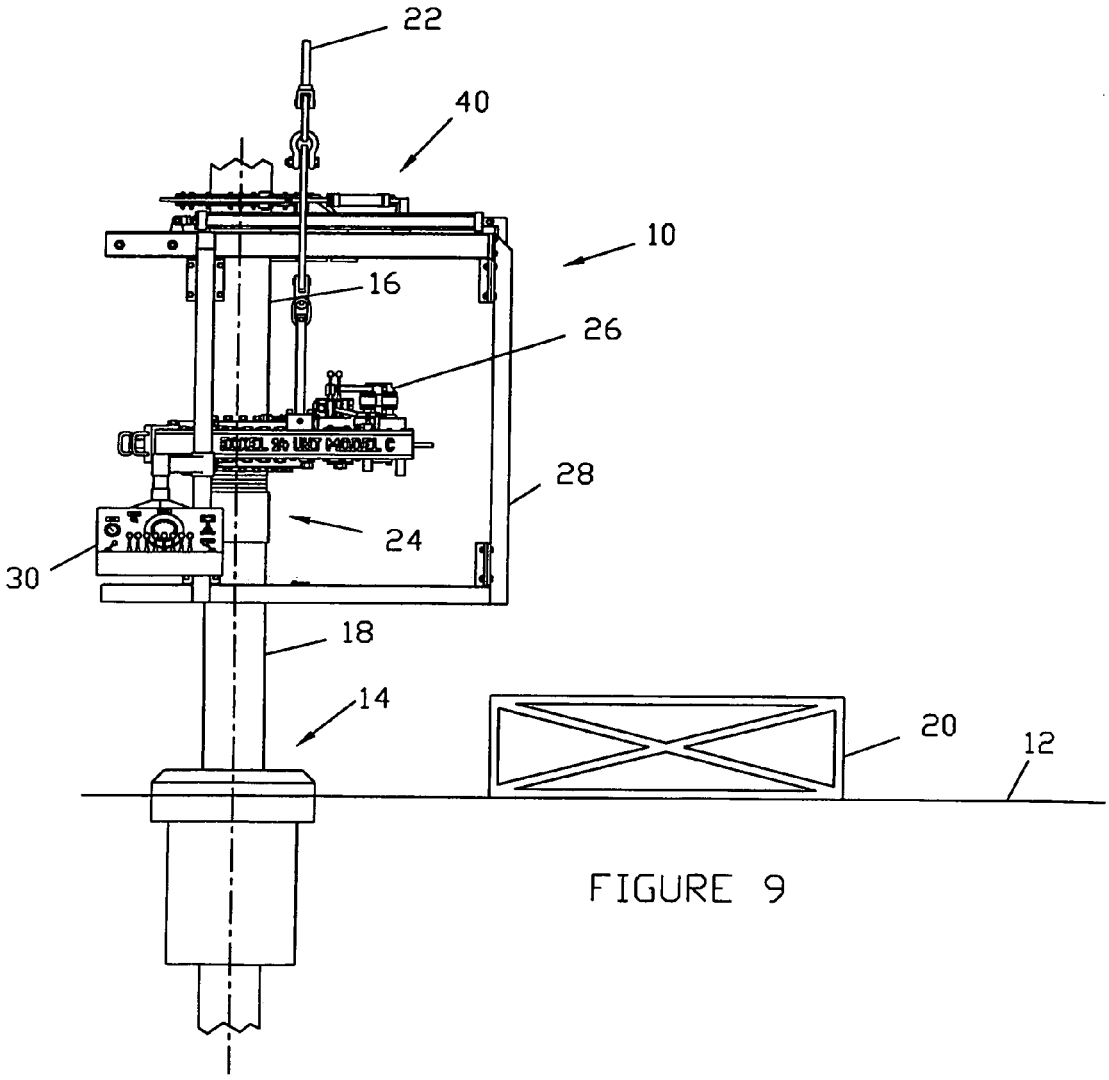
Figure 12:
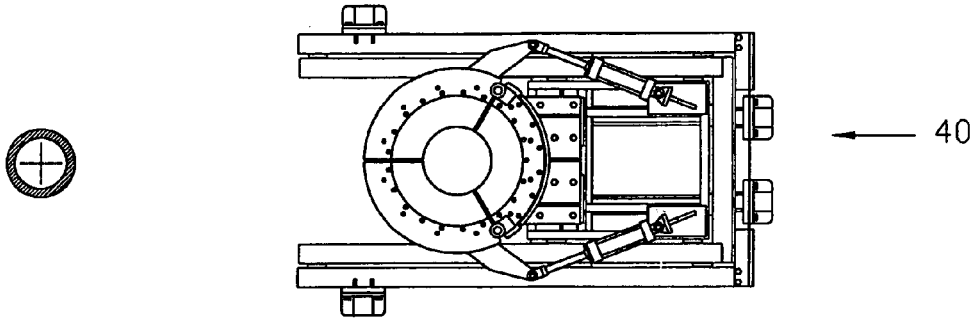
FIGS. 11–20 show another embodiment of an automated tong positioning system (ATPS) in various positions of operation.
Figure 11:
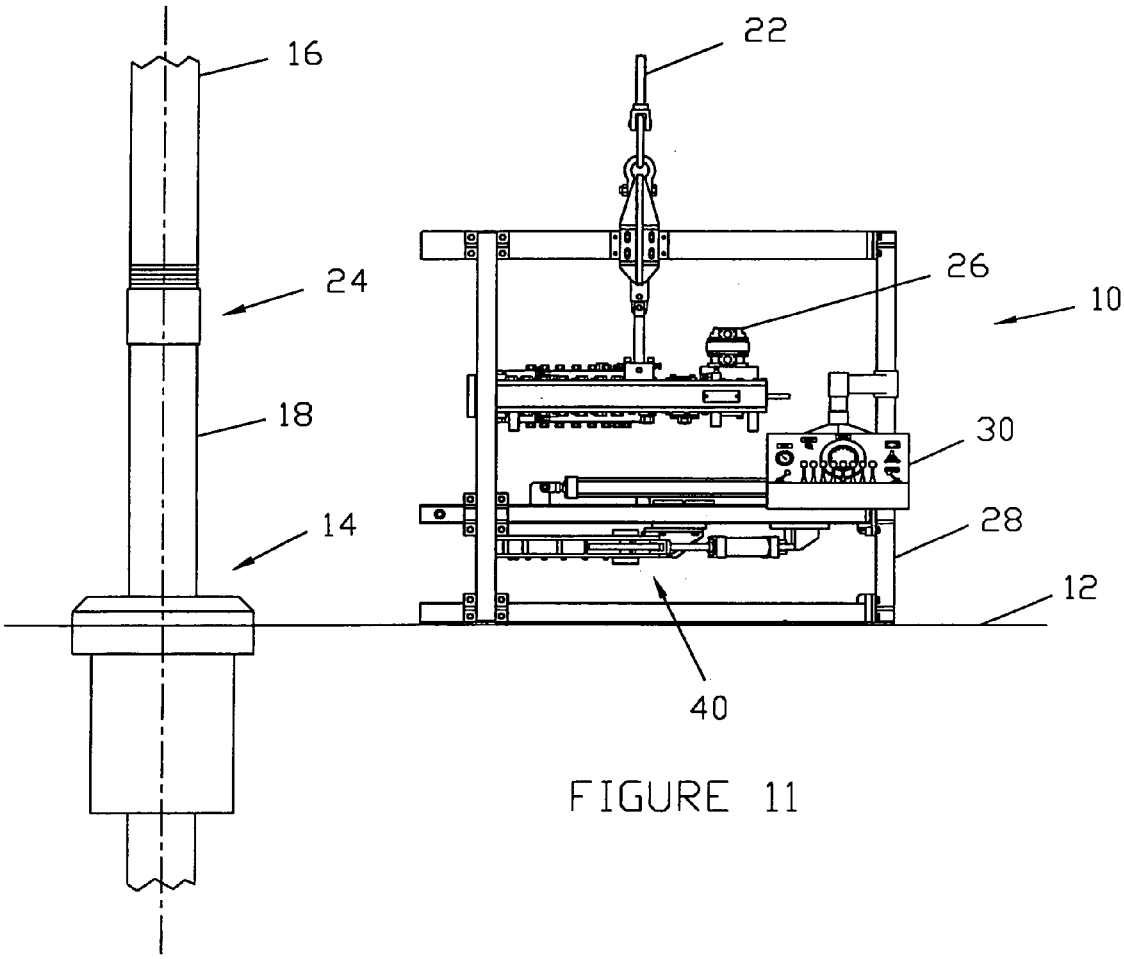
Figure 14:
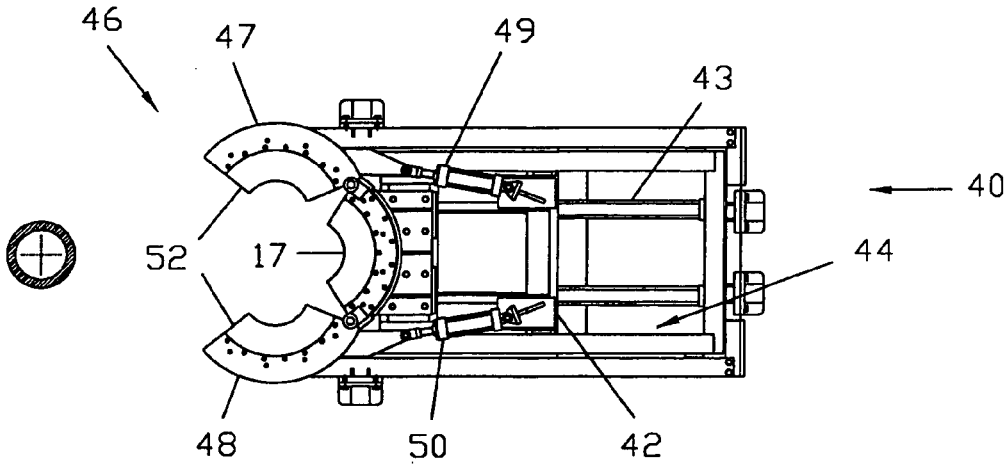
Figure 13:
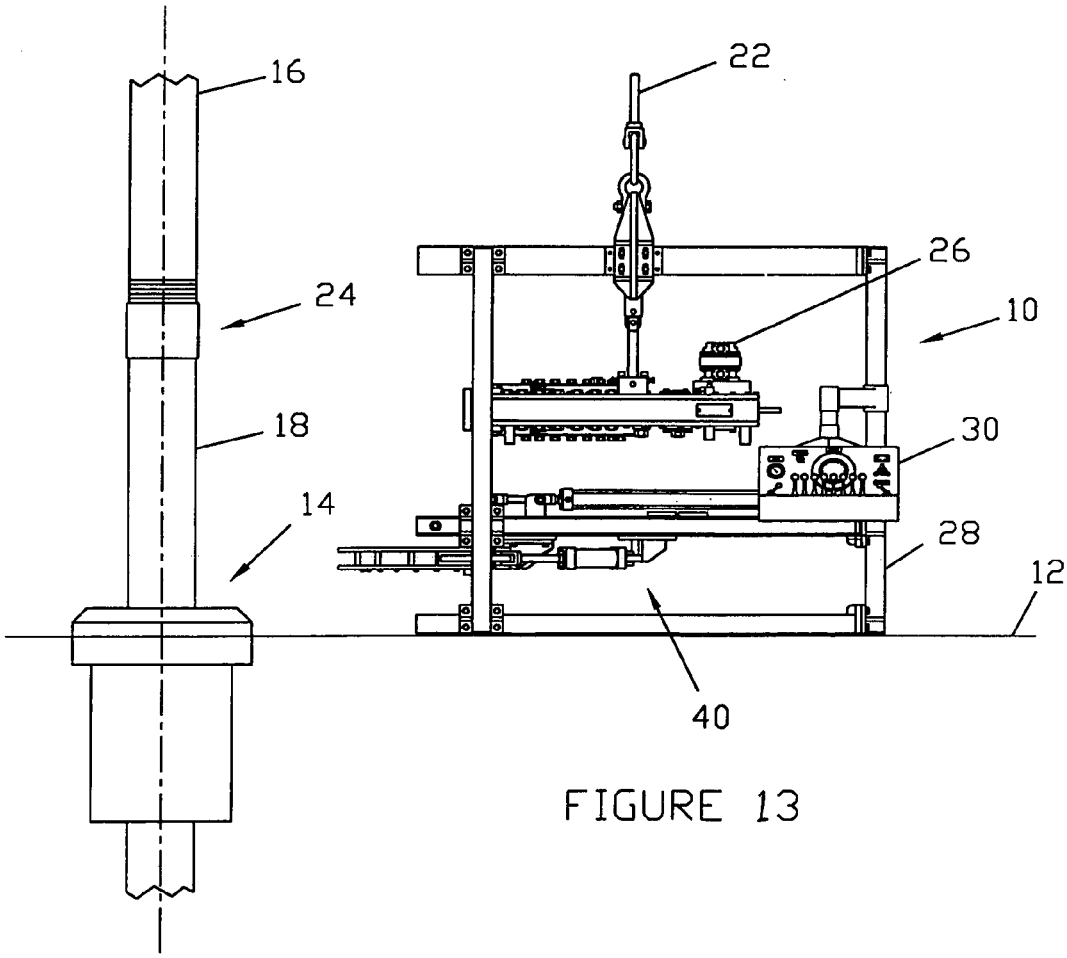
Figure 16:
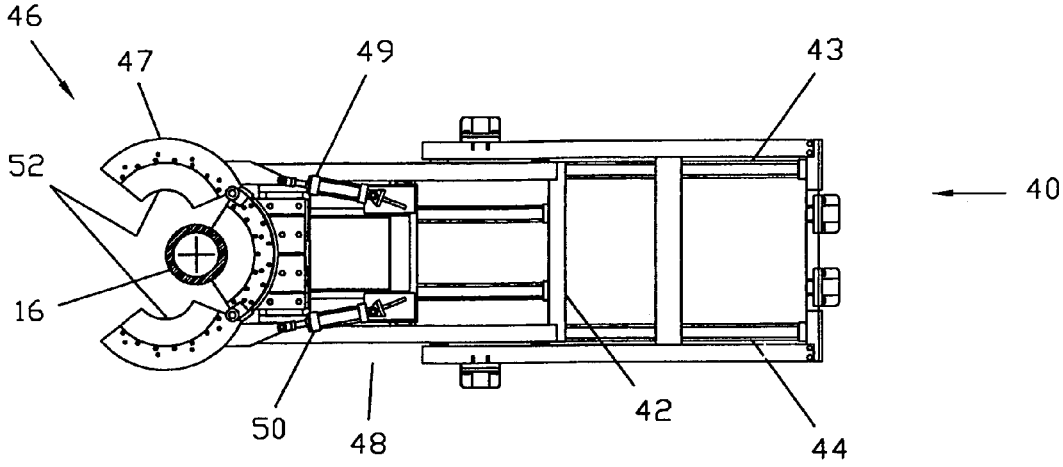
Figure 15:
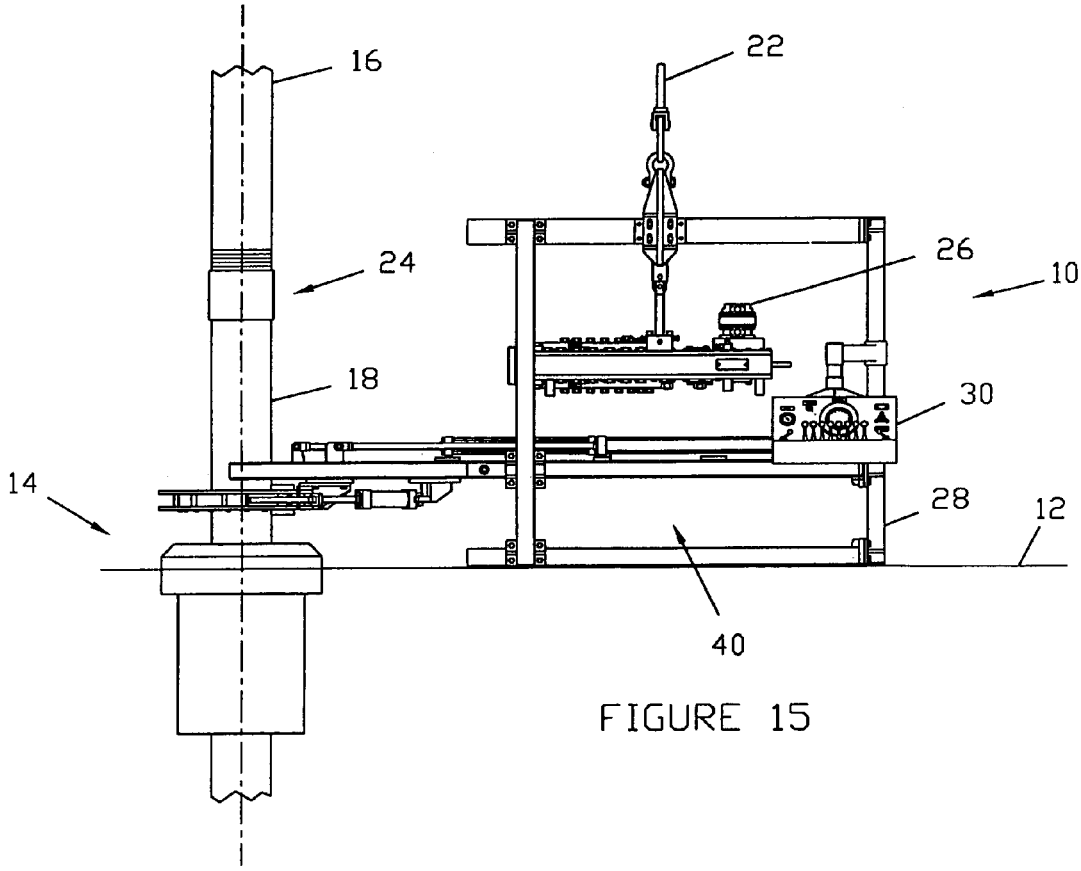
Figure 18:
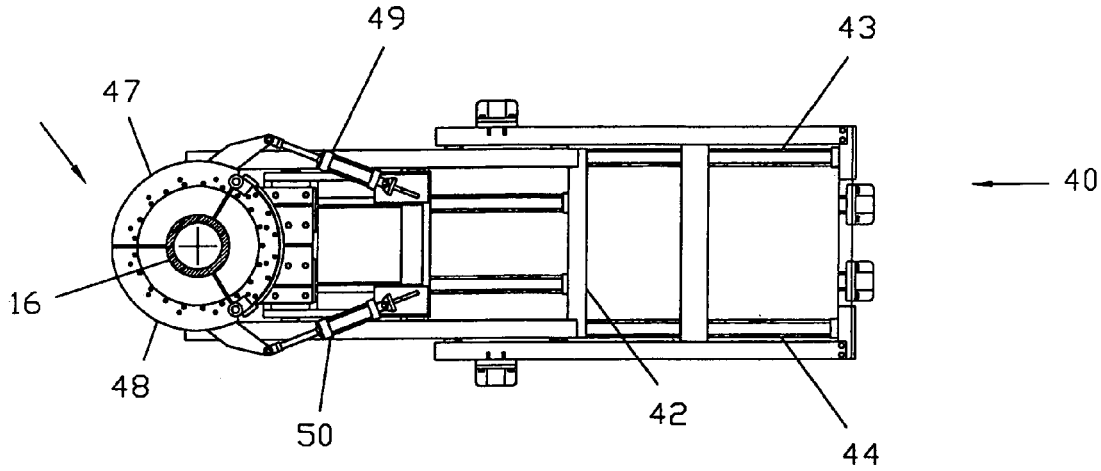
Figure 17:
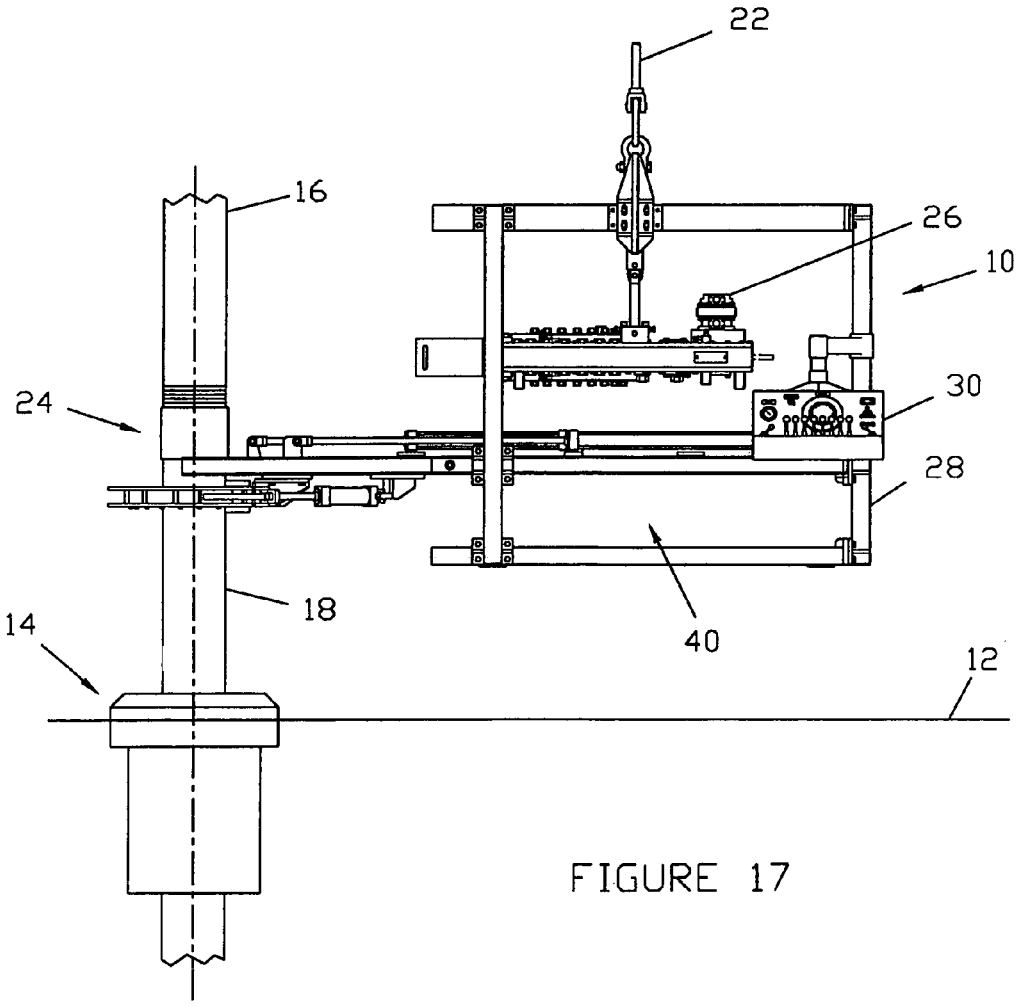
Figure 20:
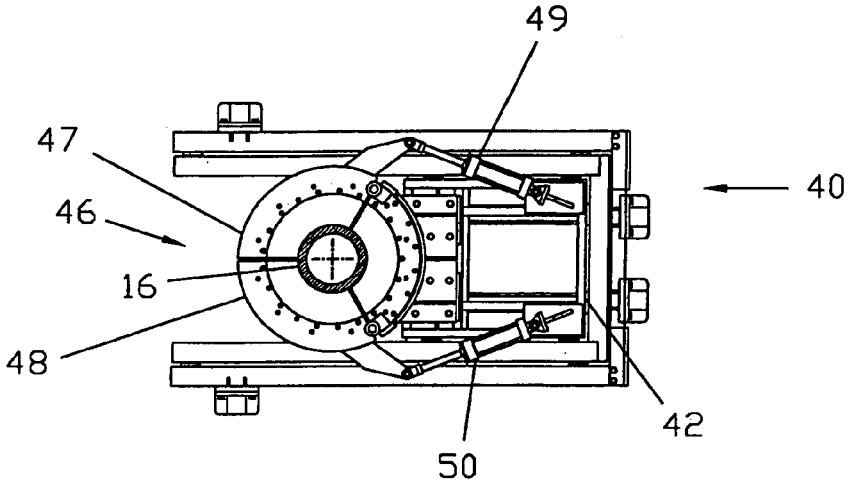
Figure 19:
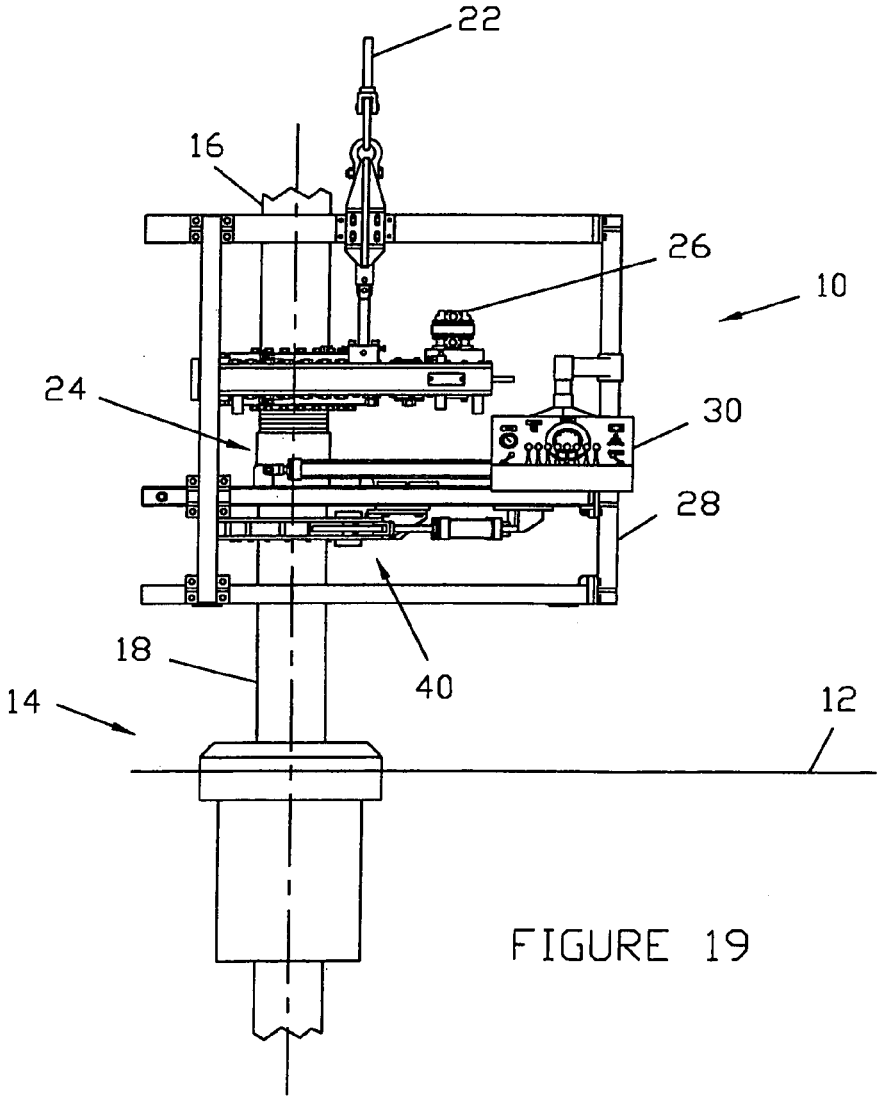

FIG. 9 shows a side-view of the ATPS 10, with the telescoping retainer assembly 40 secured to the upper tubular segment 16 and after the telescoping retainer assembly 40 has moved to a retracted position. By retracting the telescoping retainer assembly 40 while the retainer device 46 is secured about the upper tubular segment 16, the ATPS 10 is moved inwardly toward the upper tubular segment 16, to bring the tong 26 into position about the connection 24. The tong 26 is thus automatically positioned to make-up or break-out the connection 24. FIG. 10 shows a top view of the ATPS 10 of FIG. 9. FIGS. 11–20 illustrate an alternate embodiment of the tong positioning system, which may be set directly on the rig floor without a spacer box in various positions of operation. FIG. 11 shows a side view of the ATPS with the telescoping retainer assembly in the fully retracted position. FIG. 12 shows a top view of the ATPS with the telescoping retainer assembly in the fully retracted position of FIG. 11. FIG. 13 shows a side view of the ATPS with the telescoping retainer assembly in a partially extended position. FIG. 14 shows a top view of the ATPS with the telescoping retainer assembly in the partially extended position of FIG. 13. FIG. 15 shows a side view of the ATPS with the telescoping retainer assembly in a fully extended position. FIG. 16 shows a top view of the ATPS with the telescoping retainer assembly in the fully extended position of FIG. 15. FIG. 17 shows a side view of the ATPS with the telescoping retainer assembly in the fully extended position, secured to the lower tubular segment. FIG. 18 shows a top view of the ATPS with the telescoping retainer assembly in the fully extended and secured position of FIG. 17. FIG. 19 shows a top view of the ATPS with the telescoping retainer assembly secured to the lower tubular segment after the telescoping retainer assembly has moved back to the fully retracted position. FIG. 20 shows a side view of the ATPS with the telescoping retainer assembly in the secured and again retracted position of FIG. 19.

Rather than optionally resting on and being lifted from a spacer box 20 as described in conjunction with FIGS. 1–10, the ATPS 10 of FIGS. 11–20 is supported on and then lifted from the rig floor 12. The height of the ATPS 10 may be determined during manufacture, such as by taking into account that no spacer box will be used. The height of the ATPS 10 may also comprise adjustable legs 21 (see FIG. 22) for adjusting the height of the ATPS 10.

FIGS. 11–20 also illustrate that the retainer device 46 may be extended on the telescoping arm 42 toward the lower tubular segment 18 to instead engage the lower tubular segment 18. The advantages and disadvantages of engaging the upper and lower tubular segments 16, 18 are discussed below. The height of the ATPS 10 may be chosen such as to position the retainer device 46 substantially at a height along the lower tubular 18.

The embodiments of FIGS. 11–20 may lower the center of gravity of the ATPS 10 relative to the embodiment of FIGS. 1–10, helping to stabilize the ATPS 10 during operation. The spacer box 20 may not be as necessary in the latter embodiment due to the lower vertical placement of the telescoping retainer assembly 40. The lower tubular segment 18 is already constrained within the wellhead 14, providing a stable anchor point for the retainer device 46 to grip as the ATPS 10 is pulled inward toward the connection 24.

Although the embodiment of FIGS. 1–10, by contrast, may have a higher center of gravity, and a spacer box 20 may practically be necessary, the embodiment of FIGS. 11–20 has an advantage in aligning the tong 26 about the connection 24 to be made up. In the connection 24 shown, the tong 26 typically engages the upper tubular segment 16 and rotates it with respect to the lower tubular segment 18, which requires the tong 26 to be properly aligned with the upper tubular segment 16. Gripping the upper tubular segment 16 with the retainer device 46 aligns a plane of the retainer device 46 perpendicularly to an axis of the upper tubular segment 16, but the axis of the upper tubular may not be aligned with the vertical axis of the lower tubular. The FIG. 11–20 embodiment inherently aligns the tong about a portion of the upper tubing segment 16 to be turned, since the gripper is perpendicular to the fixed vertical axis of the lower tubular, thereby ensuring proper engagement as the tong 26 rotates the upper tubing segment 16. This advantage may be less significant if the upper tubular segment 16 is be at least partially inserted into the lower tubular segment 18 prior to activating the power tong. Partial insertion may thus adequately pre-align the upper and lower tubular segments 16, 18 so that the tong 26 will properly align with the upper tubular segment 18, regardless of whether the retainer device 46 engages the upper or lower tubular segments.

Both tong 26 and the retainer assembly 40 may be operated with the control box 30, which may be supported on frame 28. The control box 30 may be plumbed to the hydraulic cylinders 43, 44, 49, 50. An operator may use controls on the control box 30 to extend the telescoping arm 44, close the retaining device 46 about the upper tubing segment 16, retract the telescoping arm 44 to position the tong 26 about the connection 24, operate the tong to make-up or break-out a connection, return the tong to box 20, then release the retainer assembly 40 from the tubular connection. The control box 30 may be secured to the frame 28 of the ATPS 10, as shown. Alternatively, the control box 30 may be secured relative to the rig floor 12, and a flexible fluid and/or electrical lines may connect the control box 30 to the ATPS 10, such that the operator may control the ATPS 10 from a stationary or remote position.

To increase the range of extension of the retainer assembly 40, multiple hydraulic cylinders may be used. Each cylinder 43, 44 may thus consist of two or more axially telescoping cylinders, so that the length of any one cylinder is reduced. The telescoping arm and retainer assembly may alternatively comprise other known mechanical extension mechanisms, such as pneumatic cylinders or motor powered rack and pinion mechanisms 27, as shown in FIG. 22.

Figure 21:
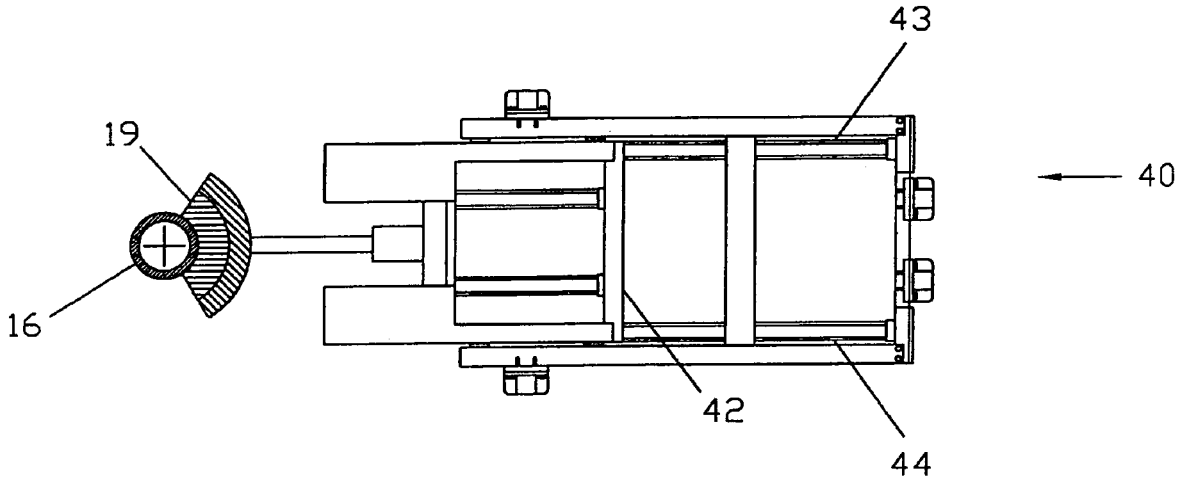
FIG. 21 illustrates an embodiment of the ATPS comprising a magnetic retaining device.

As illustrated, the retaining device 46 may form a substantially circular shape when closed for relatively uniform contact with the tubular segment. Alternatively, the retainer device need not fully enclose nor fully contact the tubular segment, so long as it secures the ATPS to the tubing segment upon retraction. For example, the retainer arms may each be V-shaped rather than curved as shown in the figures. As another example, a magnet such as an electromagnet 19, may be used to secure the extended telescoping retainer assembly to one of the tubing joints, as illustrated in FIG. 21.

When a connection 24 is to be made between tubular segments 16 and 18, the tong 26 is conventionally engaged with an upper tubular segment 16 to rotate the upper tubular segment 16 relative to a lower tubular segment 18. When the tong 26 is used to turn the upper tubular segment 6, the retaining device 46 has already contacted and engaged the upper tubular segment 16. The ATPS 10 may, therefore, squarely align the tong 26, such that the centerline of the tubular segment 16 is at a right angle with the normally horizontal plane of the tong 26. To facilitate this alignment, the retainer device 46 may be provided with a tubular contact area having a large vertical height for contacting the upper tubing segment 16. To further facilitate this alignment, the retainer device 46 may be provided with an arcuate seating surface 17 for seating with either the upper tubular segment 16 or lower tubular segment 18.

In other embodiments, especially in which it is less critical or there are alternative ways to square the ATPS 10 and the tong 26 with the upper tubular segment 16, the retainer device may instead be extended to engage a lower tubular segment, or toward another fixed feature near the tubular segment for securing the telescoping retainer assembly. The advantage of the embodiment wherein the retainer device engages the lower tubular is that the lower tubular is already constrained within the wellhead to serve as an anchor for the retainer device as the ATPS is pulled inward. Conversely, in the embodiment wherein the retainer device instead engages the upper tubular segment, the pin end of the upper segment tubular needs to be generally positioned within the box end of the lower tubular segment to constrain the upper tubular segment prior to pulling the ATPS inward.

A further advantage of the latter embodiment is that engaging the upper tubular segment with the retainer device positions the plane of the tong frame desirably at a right angle with respect to the centerline of the upper tubular segment, so that if the upper tubular segment is slightly misaligned vertically, the tong will nevertheless align itself with the upper tubular segment, which is rotated by the power tong. Tong dies or other gripping heads are then properly positioned with respect to upper tubular segment, so that when the tong is activated, the dies will uniformly grip the upper tubular segment, even if the axis of the upper tubular segment is not perfectly aligned with the axis of the lower tubular segment.

The action of moving the frame and the tong laterally toward the upper tubular means that the tong frame will tend to tilt slightly, since the lift cable 22 is no longer vertical, but is inclined at a slight angle from vertical when the tong is positioned on the upper tubular. Since the gripping member engages the upper tubular, the retaining device 46 may grip the upper tubular so that the tong is moved by the gripping action to be perpendicular to the vertical axis of the upper tubular, even though the upper pivot point for the cable 22 has not changed so that the lift cable is slightly inclined when the tong is positioned as shown in FIG. 5.

Another feature of the invention is that a counterbalance system 29 (see FIG. 22) may be provided to balance the ATPS as the telescoping arm and/or for the tong are moved laterally on or off the connection while the ATPS is operated. The weight of the counterbalance may counteract lateral movement of the telescoping arm and/or tong, so that the assembly is more balanced and thus more stable. Sufficient weight may be added to the frame or distributed to keep the ATPS steady when the arm is extended. In the embodiment of FIG. 22, for example, a mass or weight 33 may be moveable with respect to a track 35, for selectively counterbalancing the extension of the arm secured with respect to the frame, with the cantilevered end of the arm being laterally moveable toward and away from the threaded connection.

When lifting the ATPS 10 from the spacer box 20 as illustrated in Figure, the retainer device 46 slides axially with respect to the upper tubular segment 16. To facilitate this movement, a plastic material bushing 52 may be included with the retainer device 46 to act as a low-friction member for contacting and sliding engagement with the upper tubular segment 16. Alternatively, a bearing or other lower-friction interface may be provided to reduce friction between the retainer device 46 and the upper tubular segment 16.

The height of the spacer box 20 may be selected to facilitate vertical alignment of the ATPS 10 with respect to the connection 24. Alternatively, the spacer box 20 may have a variable height, and may be elevated mechanically or hydraulically by the operator to lift the ATPS 10 above the spacer box 20. In other embodiments, a spacer box 20 may not be required, and the dimensions of the frame 28 may be chosen to vertically position the tong 26 as desired with respect to the connection 24.

As shown in FIG. 1, a chain 54 or other flexible member may alternatively rotationally secure the tong 26 in place. A torque sensor may be placed along this chain to measure makeup torque, and thus the torque generated by the power tong, as a functioning the angle of the chain. Alternatively, a torque sensor may be provided for acting between the frame of the power tong and the frame of a backup tong.

Prior to extending the telescoping retainer assembly 40 to engage the retainer device with the upper tubular segment 16, the telescoping retainer assembly may have been rotationally oriented or "aimed" at the upper tubing joint 16. There are a number of ways to aim the telescoping retainer assembly. The preferred technique to properly position the extendable and retractable arm of the telescoping retainer assembly first involves placing the retainer device on a cantilevered end of the arm about the tubular connection, with the frame supported above the working surface of the rig by a cable, as illustrated, and then activating the retainer device to be at the desired predetermined active position, e.g., substantially encircling the tubular connection. The powered drive may then be activated to fully extend the arm with the retainer device still positioned about the tubular connection, and the arm rotated to a circumferential position desired by the operator. The cable may then be lowered to set the frame at a selected inactive position on the rig floor. For this embodiment, the powered drive when fully extended may thus automatically position the frame at its retracted position. In alternate embodiments, the powered drive may be extended to either the active position or the retracted position in response to sensors or suitable positions for selectively controlling, for example, the stroke of a cylinder so that it stops in either the selected active position or the selected inactive position.

Figure 24:
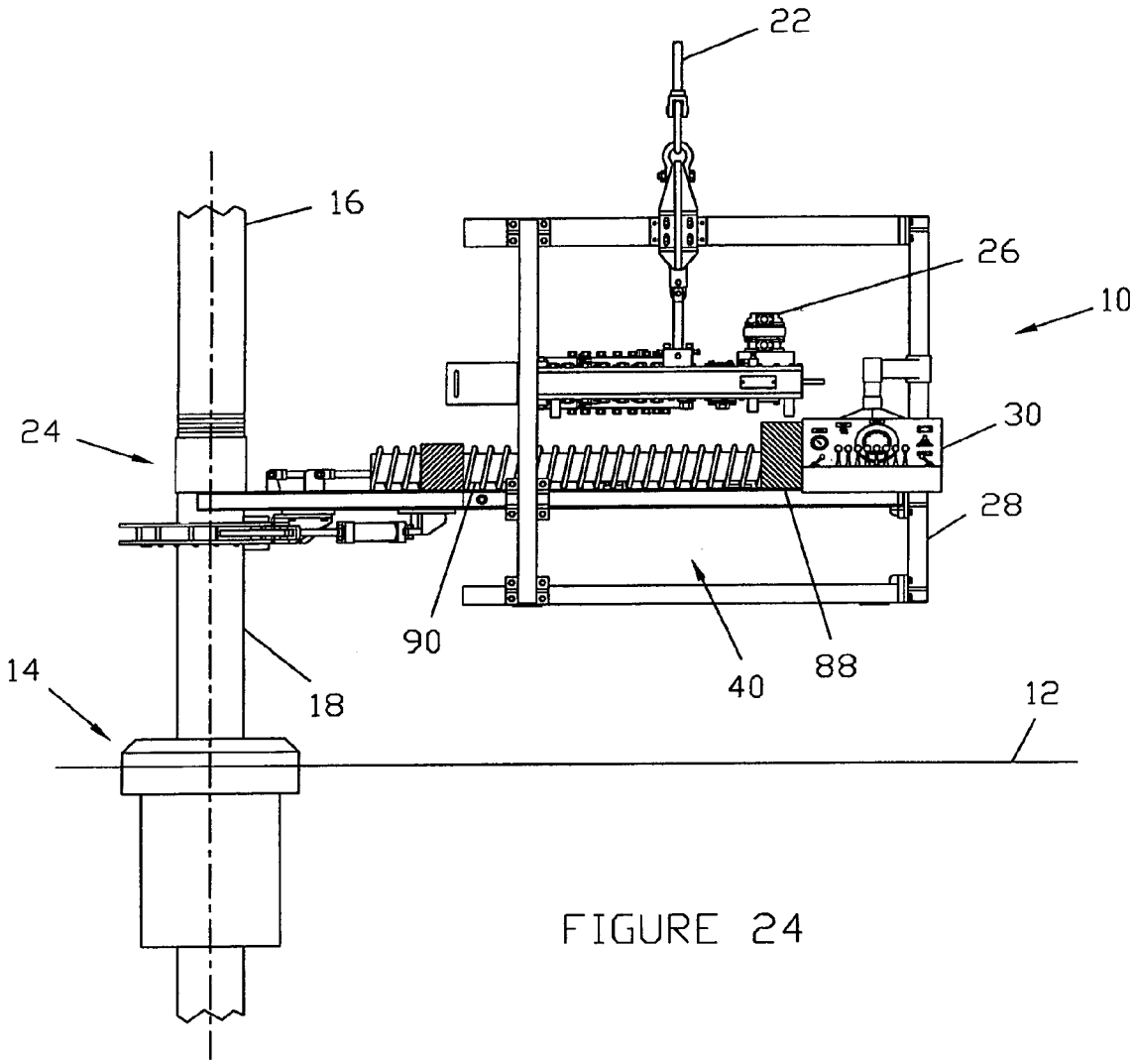
FIG. 24 illustrates a powered drive mechanism comprising an electrically powered stepper motor and a screw drive mechanism.

A preferred embodiment of the tong positioning system for many applications may comprise electrically powered stepper motor 88 as shown in FIG. 24 and a screw drive mechanism 90 for extending and retracting the arm and thus moving the retainer device toward and away from the tubular connection. This embodiment is particularly preferred for some applications since the drive mechanism is electrically rather than hydraulically powered, and since a conventional servo or stepper motor provides very precise control of the screw drive mechanism to position a retainer device precisely in the desired active and inactive positions.

The embodiments as discussed above use a powered drive for extending and retracting the arm which is secured to the frame, and this same powered drive may then be retracted after the retainer device is positioned in the active position for pulling the frame and thus the power tong and/or backup tongs supported on the frame to a desired active position to make up or breakout the threaded connection. Those skilled in the art should appreciate that alternate embodiments of the tong positioning system may include one of the variety of powered drives as disclosed for extending and retracting the arm, and a separate power drive, which may be functionally similar to or different than the initially described powered drive, for moving the tong with respect to the frame from the inactive position to the active position. In other words, a less desired embodiment of the invention may use one powered drive for extending and retracting the arm, and another power drive for moving the tong toward and away from the connection after the arm has positioned the retainer device in the substantially predetermined active position relative to the tubular connection.

According to the method invention, the arm may be extended from the inactive position to the active position, such that the retainer device is in its predetermined active position relative to the tubular connection, then the same (or another) power drive activated to reliably move the tong from the active position to the inactive position. After the connection has been made up, the power tong may begin its movement from the active to the inactive position. At substantially about the same time or shortly thereafter, the retainer device may similarly move from its active position to its inactive position, thereby moving the tong laterally away from the tubular connection. A particular feature of a preferred embodiment of the invention, wherein the power tong which extends and retracts the arm functionally extends and retracts both the retainer device and the portable frame which supports the powered tong, involves less components and, for many applications, a simpler operation than embodiments wherein one power drive extends and retracts the arm and thus retainer device, while another power drive extends and retracts the frame supporting the power tong and optionally the backup tong.

The ATPS eliminates the manual effort of "manhandling" the tong to maneuver it over the wellbore or other tubular location. The system increases safety, improves cycle time, works on any rig, and reduces operational costs. All tong functions may be controlled remotely from the operator control console, including activation of the rotary gear and opening/closing of the tong door. No other personnel are needed to manipulate the tong on and off the tubular. The ATPS will work with various tongs, allowing the operator to easily change out the tong to meet the needs of different applications.

With the ATPS hung from the rig derrick, rig up time is similar to that of conventional tongs. In setup, the spacer box may be positioned within 5 feet of the center of the wellbore. This distance is only important when the maximum clearance is needed for extra large outside diameter elevators. To align the gripper arm, hook up supply hoses may lift the ATPS off the spacer box, and point the ATPS in the direction of the center of the wellbore. Once the lift cable is attached to the frame, the frame may be lifted and pointed in the direction of the center of the wellbore. After approximately one minute of alignment, the tong will typically remain aligned.

In operation, the power unit is started up, the telescoping arm is extended, and the retainer device is opened. Once the retainer device reaches the desired tubular segment, the retainer device closes around the tubular segment. The ATPS frame may then be lifted slightly upwards by a hydraulic lift cylinder or other means conventionally used to remove weight from a spacer box. If desired, the spacer box may be provided with adjustable legs so that the heights of the tong while resting on the spacer box may be adjusted relative to the rig floor. The telescoping arm may then be retracted, pulling the ATPS frame safely and effortlessly to the tubular segment, which perfectly aligns the tong on the tubular segment. An operator may use the remote operating control for make-up or break-out operations. Once torquing operations are completed, the ATPS is removed from the tubular area by extending the telescoping arm. This pushes the ATPS frame back to the parked location, allowing very large elevators to clear with ease. The ATPS frame can then be lowered to rest on the stand. The pipe retainer device may then be opened up and the telescoping arm then retracted. The tong is under control of the tong operator at all times. The tong is not swinging freely and endangering rig personnel.

Other features include:

- The ATPS system may maneuver various brands and configuration of power tongs around the pipe connection during run-in and pulling operations.
- A single operator may easily maneuver and operate the tong from the rig floor.
- The tong will consistently align with the tubular segment.
- Cycle time is improved between make-up and break-out.
- The operator may control all functions of the tong and tong positioning system from safely behind a control console.
- No casing stands or scaffolds are required.
- Rig floor accidents are reduced.
- Personnel are reduced.
- The system returns to a parked location between make-up and break-out.
- The system requires no magnetism, no rig floor tracks, and no bolting or welding to the rig.
- The system insures a proper tubular torque and a corresponding smooth torque turn graph when torque turning is needed.
- The system is well suited for deep water wells, rocking drill ships, floaters, and land rigs.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. A tong positioning system for positioning a power tong about an oilfield tubular connection to rotatably make up or break out the connection on a rig of a well, a lower end of the upper tubular including threads for mating with threads on an upper end of the lower tubular, the tong positioning system comprising:

a portable frame selectively positionable on the rig with respect to the connection at an inactive position, the frame being moveable laterally with respect to the connection to an active position;

an extendable arm having a supported end secured to the frame and a cantilevered end, the cantilevered and being extendable and retractable laterally toward and away from the tubular connection with respect to the frame;

a retainer device on the cantilevered end of the extendable arm moveable to a substantially predetermined active position relative to the tubular connection, the retainer device defining an adjustable opening, such that the adjustable opening may be widened to pass the connection through the adjustable opening, and thereafter narrowed for at least partially enclosing the connection when the extendable arm is moved to the active position; and a powered drive for extending and retracting the arm.

2. A tong positioning system as defined in claim 1, wherein the powered drive comprises one or more hydraulically powered cylinders.

3. A tong positioning system as defined in claim 1, wherein the powered drive comprises:

a screw drive mechanism powered by an electrically powered drive.

4. A tong positioning system as defined in claim 1, wherein the retainer device further comprises:

opposing retainer arms laterally movable toward and away from one another, the retainer arms defining the adjustable opening between the retainer arms, such that moving the retainer arms toward one another narrows the adjustable opening, and moving the retainer arms away from one another widens the adjustable opening.

5. A tong positioning system as defined in claim 4, wherein the retainer device further comprises at least one fluid powered cylinder for moving at least one of the retainer arms toward another of the retainer arms to narrow or widen the adjustable opening.

6. A tong positioning system as defined in claim 1, further comprising:

a backup tong for rotationally holding one of the upper and lower tubular stationary while the power tong rotates the other of the upper and lower tubular.

7. A tong positioning system as defined in claim 1, further comprising:

a spacer box positionable on the rig for selectively supporting the frame.

8. A tong positioning system as defined in claim 7, further comprising:

adjustable legs vertically movable for adjusting the height of the frame relative to the connection.

9. A tong positioning system as defined in claim 1, further comprising;

a counterbalance member for counterbalancing the extendable arm.

10. A tong positioning system as defined in claim 1, wherein the retainer device further comprises;

a low friction member positioned for contact with one of the upper tubular and the lower tubular, thereby reducing friction between the retainer device and the connection.

11. A tong positioning system as defined in claim 1, further comprising:

with the retainer device in the active position, the powered drive moving the frame and the power tong supported on the frame from an inactive position wherein the power tong is spaced from the connection to an active position wherein the power tong makes up the connection.

12. A tong positioning system as defined in claim 1, wherein the retainer device further comprises:

an arcuate seating surface for seating with the one of the upper tubular and the lower tubular.

13. A tong positioning system as defined in claim 1, further comprising:

at least one flexible member secured to the power tong for resisting torque generated by the power tong.

14. A tong positioning system as defined in claim 1, further comprising:

a lifting member removably securable to the frame for lifting the frame and the power tong.

15. A method of positioning a power tong about an oilfield tubular connection to rotatively makeup or breakout the connection on the rig of a well, a lower end of the upper tubular including threads for mating with threads on an upper end of a lower tubular, the method comprising:

selectively positioning a portable frame on the rig with respect to the connection at an inactive position, the portable frame being moveably laterally with respect to the connection to an active position;

securing an extendable arm at one end to the frame, the extendable arm having a cantilevered end extendable and retractable laterally with respect to the frame toward and away from the tubular connection;

providing a retainer device on the cantilevered end of the extendable arm, with the retainer device being moveable to a substantially predetermined active position relative to the tubular connection;

powering a drive mechanism for selectively extending the arm to move the retainer device to the active position; and powering the drive mechanism for selectively retracting the arm while the retainer device remains in the active position to move the frame and the power tong to the active position.

16. A method as defined in claim 15, further comprising:

powering one or more hydraulic cylinders to extend the arm.

17. A method as defined in claim 15, further comprising:

powering an electrical motor to activate a screw drive mechanism to extend and retract the arm.

18. A method as defined in claim 15, further comprising:

positioning the tong position system such that the retainer device engages a lower tubular.

19. A method as defined in claim 15, further comprising:

supporting a power tong on the frame, and supporting a backup tong on the frame for rotationally holding one tubular stationary while the other tubular is being threaded or unthreaded by the power tong.

20. A method as defined in claim 15, further comprising:

providing a counterbalance member to counterbalance the extendable arm.

21. A method as defined in claim 15, further comprising:

positioning a low friction member to contact one of the upper and lower tubulars to reduce friction between the retainer device and the threaded connection.

22. A tong positioning system for positioning a power tong about an oilfield tubular connection to rotatably make up or break out the connection on a rig of a well, a lower end of the upper tubular including threads for mating with threads on an upper end of the lower tubular, the tong positioning system comprising:

a portable frame on the rig selectively positionable on the rig with respect to the connection at an inactive position, the frame being moveable laterally with respect to the connection to an active position;

an extendable arm having a supported end secured to the frame and a cantilevered end, the cantilevered end being extendable and retractable laterally toward and away from the tubular connection with respect to the frame, a retainer device on the cantilevered end of the extendable arm moveable to a substantially predetermined active position relative to the tubular connection, the retaining device comprising a magnetic member for positioning the cantilevered end in the active position relative to the tubular connection; and a powered drive for extending and retracting the arm.

23. A tong positioning system as defined in claim 22, wherein the magnetic member comprises an electromagnetic.

24. A tong positioning system as defined in claim 22, wherein the powered drive comprises:

a screw drive mechanism powered by an electrically powered drive.

25. A tong positioning system as defined in claim 22, further comprising:

a spacer box positionable on the rig for selectively supporting the frame.

26. A tong positioning system as defined in claim 22, wherein the retainer device further comprises:

a low friction member positioned for contact with one of the upper tubular and the lower tubular, thereby reducing friction between the retainer device and the connection.

27. A tong positioning system for positioning a power tong about an oilfield tubular connection to rotatably make up or break out the connection on a rig of a well, a lower end of the upper tubular including threads for mating with threads on an upper end of the lower tubular, the tong positioning system comprising:

a portable frame selectively positionable on the rig with respect to the connection at an inactive position, the frame being moveable laterally with respect to the connection to an active position;

an extendable arm having a supported end secured to the frame and a cantilevered end, the cantilevered and being extendable and retractable laterally toward and away from the tubular connection with respect to the frame;

a retainer device on the cantilevered end of the extendable arm moveable to a substantially predetermined active position relative to the tubular connection; and a powered drive for extending and retracting the arm, the powered drive comprising a screw drive mechanism powered by an electrically powered drive for extending and retracting the arm.

28. A tong positioning system as defined in claim 27, further comprising:

a spacer box positionable on the rig for selectively supporting the frame.

29. A tong positioning system as defined in claim 27, further comprising:

adjustable legs vertically movable for adjusting the height of the frame relative to the connection.

30. A tong positioning system as defined in claim 27, further comprising:

a counterbalance member for counterbalancing the extendable arm.

31. A tong positioning system as defined in claim 27, wherein the retainer device further comprises:

a low friction member positioned for contact with one of the upper tubular and the lower tubular, thereby reducing friction between the retainer device and the connection.

32. A tong positioning system as defined in claim 27, further comprising:

with the retainer device in the active position, the powered drive moving the frame and the power tong supported on the frame from an inactive position wherein the power tong is spaced from the connection to an active position wherein the power tong makes up the connection.

33. A tong positioning system as defined in claim 27, further comprising:

at least one flexible member secured to the power tong for resisting torque generated by the power tong.

34. A tong positioning system for positioning a power tong about an oilfield tubular connection to rotatably make up or break out the connection on a rig of a well, a lower end of the upper tubular including threads for mating with threads on an upper end of the lower tubular, the tong positioning system comprising:

a portable frame selectively positionable on the rig with respect to the connection at an inactive position, the frame being moveable laterally with respect to the connection to an active position:

an extendable arm having a supported end secured to the frame and a cantilevered end, the cantilevered and being extendable and retractable laterally toward and away from the tubular connection with respect to the frame;

a retainer device on the cantilevered end of the extendable arm moveable to a substantially predetermined active position relative to the tubular connection;

a powered drive for extending and retracting the arm; and a spacer box positionable on the rig for selectively supporting the frame.

35. A tong positioning system as defined in claim 34, further comprising:

adjustable legs vertically movable for adjusting the height of the frame relative to the connection.

36. A tong positioning system as defined in claim 34, further comprising:

a counterbalance member for counterbalancing the extendable arm.

37. A tong positioning system as defined in claim 34, wherein the retainer device further comprises:

a low friction member positioned for contact with one of the upper tubular and the lower tubular, thereby friction between the retainer device and the connection.

38. A tong positioning system as defined in claim 34, further comprising:

with the retainer device in the active position, the powered drive moving the frame and the power tong supported on the frame from an inactive position wherein the power tong is spaced from the connection to an active position wherein the power tong makes up the connection.

39. A tong positioning system as defined in claim 34, wherein the powered drive comprises one or more hydraulically powered cylinders.

* * * * *